US011592201B2

(12) United States Patent
Brown et al.

(10) Patent No.: US 11,592,201 B2
(45) **Date of Patent: *Feb. 28, 2023**

(54) SPACE CONDITIONING CONTROL AND MONITORING METHOD AND SYSTEM

(71) Applicant: WaterFurnace International, Inc., Fort Wayne, IN (US)

(72) Inventors: Robert R. Brown, Markle, IN (US); Nicholas Hartman, Fort Wayne, IN (US); Aaron Lindsey, Geneva, IN (US); Michael Taylor, Markle, IN (US); Caleb Chichester, Ossian, IN (US); Bruce Henderson, Fort Wayne, IN (US); Chris Mann, Ossian, IN (US); George Yang, Fort Wayne, IN (US); Timothy Hammond, Harlan, IN (US); Matthew Kolter, Hoagland, IN (US); Troy Moon, Fort Wayne, IN (US)

(73) Assignee: WATERFURNACE INTERNATIONAL INC., Fort Wayne, IN (US)

( * ) Notice: Subject to any disclaimer, the term of this patent is extended or adjusted under 35 U.S.C. 154(b) by 134 days.

This patent is subject to a terminal disclaimer.

(21) Appl. No.: 17/034,610

(22) Filed: Sep. 28, 2020

(65) Prior Publication Data

US 2021/0010703 A1 Jan. 14, 2021

Related U.S. Application Data

(63) Continuation of application No. 14/213,060, filed on Mar. 14, 2014, now Pat. No. 10,788,227.

(Continued)

(51) Int. Cl.

| | |
|---|---|
| ***F24F 11/46*** | (2018.01) |
| ***F24F 11/30*** | (2018.01) |
| ***F24F 11/63*** | (2018.01) |
| ***F24F 11/77*** | (2018.01) |
| ***F24F 11/81*** | (2018.01) |
| ***F24F 11/83*** | (2018.01) |
| ***F24F 11/86*** | (2018.01) |

(Continued)

(52) U.S. Cl.

CPC ..... *F24F 11/46* (2018.01); *F24F 11/30* (2018.01); *F24F 11/63* (2018.01); *F24F 11/77* (2018.01); *F24F 11/81* (2018.01); *F24F 11/83* (2018.01); *F24F 11/86* (2018.01); *F24F 11/52* (2018.01); *F24F 11/58* (2018.01); *F24F 2110/10* (2018.01); *F24F 2110/20* (2018.01); *F24F 2140/00* (2018.01)

(58) Field of Classification Search

CPC ..... F24F 11/30; F24F 11/47; F24F 11/58

See application file for complete search history.

(56) References Cited

U.S. PATENT DOCUMENTS

| | | |
|---|---|---|
| 2,545,054 A | 3/1951 | Stitz |
| 3,734,169 A | 5/1973 | Falk |

(Continued)

*Primary Examiner* — Christopher R Zerphey

(74) *Attorney, Agent, or Firm* — Neal, Gerber & Eisenberg LLP; Thomas E. Williams

(57) ABSTRACT

A space conditioning system and method for monitoring electrical parameters and/or thermodynamic parameters relating to the heat of extraction/rejection or power consumption of the system and to communicate the monitored parameters to an external device.

31 Claims, 8 Drawing Sheets

Related U.S. Application Data

(60) Provisional application No. 61/794,722, filed on Mar. 15, 2013.

(51) Int. Cl.

| | |
|---|---|
| ***F24F 11/52*** | (2018.01) |
| ***F24F 11/58*** | (2018.01) |
| *F24F 110/10* | (2018.01) |
| *F24F 110/20* | (2018.01) |
| *F24F 140/00* | (2018.01) |

(56) References Cited

U.S. PATENT DOCUMENTS

| | | | | |
|---|---|---|---|---|
| 4,141,407 | A | 2/1979 | Briscoe et al. | |
| 4,514,989 | A | 5/1985 | Mount | |
| 4,799,005 | A | 1/1989 | Fernandes | |
| 4,884,021 | A | 11/1989 | Hammond et al. | |
| 5,289,362 | A * | 2/1994 | Liebl | G05D 23/1923 705/412 |
| 8,160,752 | B2 * | 4/2012 | Weaver | G05D 23/1927 315/307 |
| 8,761,944 | B2 * | 6/2014 | Drew | G05D 23/1902 705/412 |
| 8,791,592 | B2 * | 7/2014 | Kim | H02J 3/466 307/29 |
| 8,843,238 | B2 * | 9/2014 | Wenzel | H04L 12/14 236/44 C |
| 8,862,280 | B1 * | 10/2014 | Dyess | F24F 11/30 700/291 |
| 9,031,706 | B2 * | 5/2015 | Kim | F24F 11/62 700/297 |
| 9,595,070 | B2 * | 3/2017 | Matsuoka | G05B 13/0265 |
| 10,788,227 | B2 * | 9/2020 | Brown | F24F 11/30 |
| 2003/0132850 | A1 | 7/2003 | Ozawa | |
| 2003/0201097 | A1 | 10/2003 | Zeigler et al. | |
| 2007/0000262 | A1 | 1/2007 | Ikegami et al. | |
| 2009/0037142 | A1 | 2/2009 | Kates | |
| 2009/0216382 | A1 * | 8/2009 | Ng | F24F 11/30 700/278 |
| 2010/0102136 | A1 | 4/2010 | Hadzidedic et al. | |
| 2011/0146317 | A1 | 6/2011 | Cline et al. | |
| 2011/0209487 | A1 | 9/2011 | Tachiki et al. | |
| 2011/0296861 | A1 | 12/2011 | Honda | |
| 2012/0047929 | A1 | 3/2012 | Delorme et al. | |
| 2012/0210736 | A1 | 8/2012 | Rockenfeller et al. | |
| 2013/0018609 | A1 | 1/2013 | Filippenko et al. | |
| 2013/0024799 | A1 | 1/2013 | Fadell et al. | |
| 2014/0316584 | A1 | 10/2014 | Matsuoka et al. | |

* cited by examiner

SPACE CONDITIONING CONTROL AND MONITORING METHOD AND SYSTEM

CROSS-REFERENCE TO RELATED APPLICATIONS

This application is a continuation of U.S. application Ser. No. 14/213,060, filed on Mar. 14, 2014, which claims the benefit of and priority to U.S. Provisional Patent Application No. 61/794,722, filed on Mar. 15, 2013 entitled SPACE CONDITIONING CONTROL AND MONITORING METHOD AND SYSTEM. These applications are incorporated by reference herein in their entirety.

TECHNICAL FIELD

The disclosure relates generally to methods and systems to control air temperatures in spaces. More particularly, the disclosure relates to measurement and control methods and systems for space conditioning systems.

BACKGROUND OF THE DISCLOSURE

A space conditioning system is configured to exchange heat between the environment and a target space to condition the space therein. Space conditioning systems have a load loop coupled to a source loop. The load loop exchanges thermal energy with the target space. The source loop transfers energy between the environment and the load loop. Exemplary space conditioning systems include source/load loop combinations such as liquid/air, liquid/liquid, air/liquid and air/air. Liquid load loops include, for example, radiant floor systems.

A typical space conditioning system may include a compressor that circulates a refrigerant in a load loop to extract or inject heat from or to a target space. An indoor coil, a motor-driven fan blowing air through the coil to condition the air, and control logic cooperate to maintain a target temperature in the target space. A heater, e.g. gas or electric, may be provided to heat the target space in winter. The control logic controls the compressor and fan motors. The fan, or blower, may be driven by a variable speed drive. Generally, a condenser rejects heat to the air outside the conditioned space, e.g. to the outside environment. The heat may also be transferred by a fluid to the earth in an earth ground loop.

A heat pump system is a space conditioning system that provides both heating and cooling by reversing the flow of refrigerant. The heat pump system extracts heat from the target space in a cooling mode and injects heat in a heating mode. In winter, the heat pump system may receive heat from the source loop and exchange the heat with the load loop to heat the target space. The heater may provide auxiliary heat in winter.

Traditionally, a thermostat connected to the control logic enables a user to set target temperatures according to a programmable schedule. Users may program temperature setpoints to save energy. For example, users may program daytime temperature setpoints, when a home is typically unoccupied, to be lower than a comfortable cold temperature in winter and higher than a comfortable hot temperature in summer. The energy saving temperature may be referred to as "temperature setback." The setback temperature may present a level of discomfort to users in the home during the setback period.

Users are generally unable to determine if the level of discomfort is worth the energy saved, for several reasons.

One reason is that power monitoring systems may be too expensive for use in homes. Another reason is that heat pumps are complicated. Heat pumps operate efficiently in winter until they reach a balance point, at which time auxiliary heating kicks in to make up for the inability of the heat pump to maintain setpoint temperature. Because hot air from a heat pump might not be as hot as heat from an auxiliary heater, for example, it may take longer for a heat pump to raise the temperature of a home. If the user programs a temperature setback, the thermostat may call for auxiliary heating during the transition between temperature setback and a higher temperature setpoint. The transition time may be referred to as the "recovery time." Under such conditions, the steady-state efficiency of the heat pump may be higher than the efficiency during the recovery time. A further reason is that the cost of electricity depends on when it is used. During peak periods, it is more expensive to use electricity than during off-peak periods.

There is a need to provide cost effective devices to measure power consumption and devices capable of providing information to users concerning the efficiency of space conditioning systems.

SUMMARY OF DISCLOSED EMBODIMENTS

Embodiments of a space conditioning system and a method of monitoring a space conditioning system are disclosed herein. In one embodiment, the space conditioning system comprises an outlet port configured to discharge a liquid and an inlet port configured to receive the liquid. The liquid flows in a loop comprising one of a source loop and a load loop from the outlet port to the inlet port, the liquid exchanging energy while in the loop. The system further comprises temperature sensors to measure a temperature differential of the liquid; a flow sensor to measure a flow rate of the liquid; and a control module including communication logic adapted to output monitored parameters through a communications network. The control module further includes monitoring logic to determine the monitored parameters. The monitored parameters include a heat of extraction/rejection of the system which is based on the temperature differential and the flow rate of the liquid.

In another embodiment, the space conditioning system comprises a heat exchanger coupled to a source loop and to a load loop; a first motor operable to circulate a liquid through one of the source loop and the load loop; a second motor operable to drive a fan; a third motor operable to circulate a fluid associated with the other of the source loop and the load loop; and a control module including communication logic adapted to output monitored parameters through a communications network. The control module further includes monitoring logic to determine monitored parameters. The monitored parameters include a heat of extraction/rejection of the system which is based on a temperature differential of the liquid and a flow rate of the liquid.

In a further embodiment, the system comprises a heat exchanger coupled to a source loop and to a load loop; a fan having a fan speed configured for circulating air through the heat exchanger; temperature sensors to measure a temperature differential of the air; and a control module. The control module includes communication logic adapted to output monitored parameters through a communications network, and monitoring logic to determine the monitored parameters. The monitored parameters include a heat of extraction/rejection of the system which is based on the temperature differential and an indication of the air flow of the air circulated through the heat exchanger.

Embodiments of a method of monitoring a space conditioning system are also disclosed. In one embodiment, the method of monitoring a space conditioning system comprises: monitoring an inflow temperature, an outflow temperature, and a flow rate of a liquid operable to exchange thermal energy; determining a thermal energy exchanged by the liquid; determining power consumed by the system; calculating an energy parameter based on the power and the thermal energy; and presenting the energy parameter with a user interface.

BRIEF DESCRIPTION OF THE DRAWINGS

The above-mentioned and other disclosed features, the manner of attaining them, and the benefits and advantages thereof, will become more apparent and will be better understood by reference to the following description of disclosed embodiments taken in conjunction with the accompanying drawings, wherein.

Figure 1:
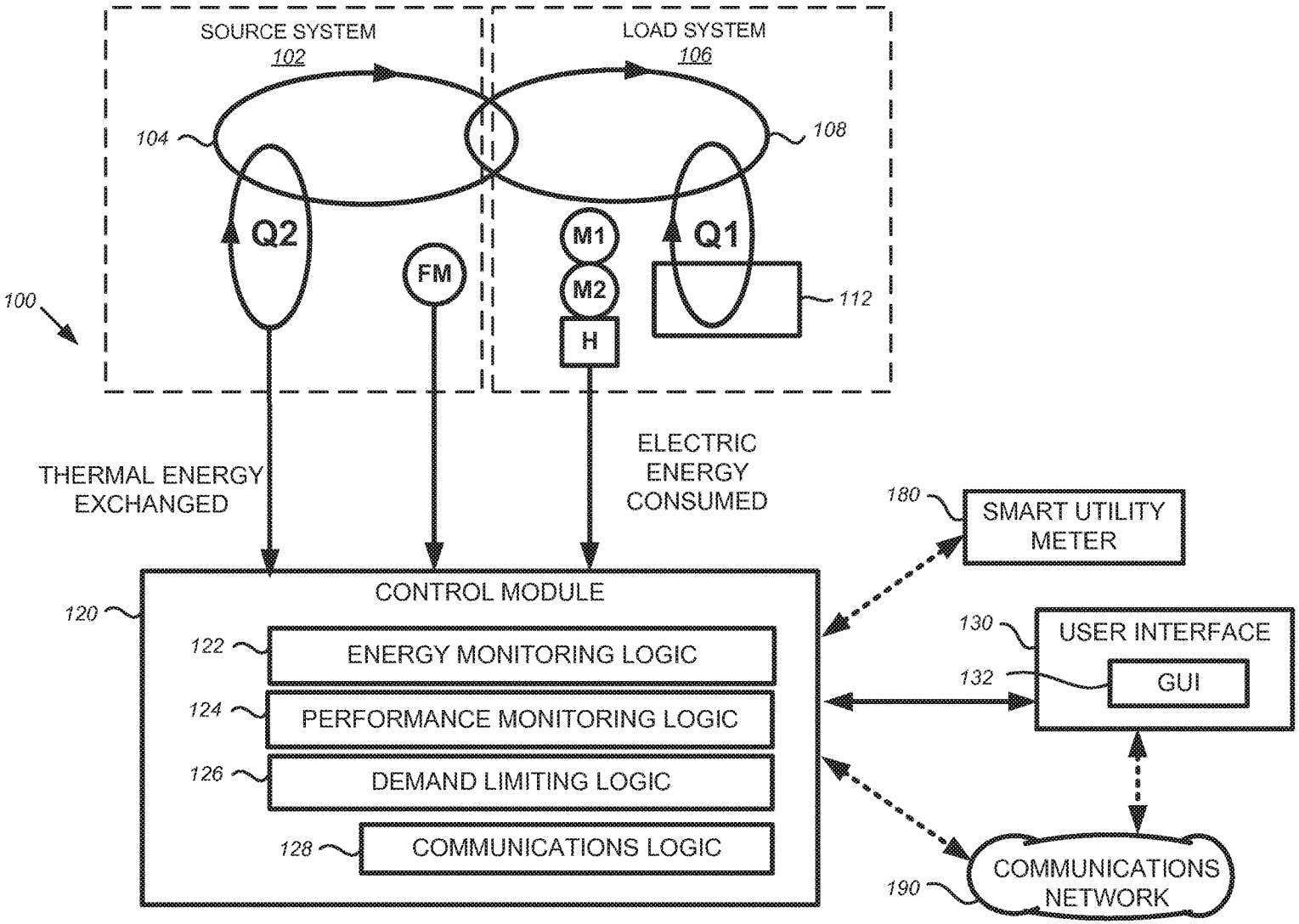
FIG. 1 is a conceptual diagram of a space conditioning system in accordance with an embodiment set forth in the disclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present invention. The exemplification set out herein illustrates embodiments of the disclosure, and such exemplifications are not to be construed as limiting the scope of the invention in any manner.

DETAILED DESCRIPTION OF EXEMPLARY EMBODIMENTS OF THE INVENTION

Briefly, a system to condition air, such as a heat pump system, includes sensors configured to determine the electrical power consumed by the system and the thermal energy exchanged with the environment. Performance monitoring logic calculates the power consumed to maintain a desired temperature in a target space and compares the consumed power to the energy exchanged with the environment to determine operating parameters of the system. Users may monitor and program system parameters with local or remote user interfaces via communications logic. For example, users may program temperature setpoints for the target space to balance energy savings and comfort.

FIG. 1 is a conceptual diagram of an embodiment of a space conditioning system, denoted by numeral 100. Space conditioning system 100 includes a load loop 108 and a source loop 104. Load loop 108 is configured to add or remove heat Q1 to/from a target space 112. Source loop 104 is configured to exchange heat with load loop 108 and to add or remove heat Q2 to/from the environment. A control module 120 controls a target temperature of target space 112 by controlling load loop 108 and source loop 104. Source and load loops may use a fluid medium such as air or a liquid, e.g. water as the energy exchange medium. Exemplary source/load loop combinations include liquid/air, liquid/liquid, air/liquid and air/air. Liquid source loops may be ground coupled, groundwater coupled, and waterloop coupled, e.g. coupled to a cooling tower/boiler.

In the present embodiment, control module 120 includes energy monitoring logic 122, performance monitoring logic 124, an optional demand limiting logic 126 and communications logic 128. Energy monitoring logic 122 is configured to receive temperature, humidity, flow and other signals, depending on the type of system, from sensors coupled to source loop 104 and to calculate the value of heat Q2 based on the signals. In a liquid based source loop, Q1 or Q2 are based on the inflow and outflow temperature differential and the flow rate of the liquid. In an air based source or load loop, energy exchange is determined by mass flow computations which include air flow. Air flow may be estimated based on the velocity of a fan and empirical data correlating the velocity to air flow, adjusted for air density, as know in the art. Performance monitoring logic 124 configured to calculate the electrical power consumed by one or more electrical devices of space conditioning system 100 based on voltage and current signals sensed by voltage and current sensors, as described with reference to FIGS. 3, 4 and 7. Power consumers include motors and electric heaters. If a gas heater is used, gas consumption can be used to estimate energy added to the system.

Embodiments of communications logic 128 may include an interface to communicate with a smart utility meter 180, an interface to communicate with a user interface 130, and an interface to communicate with a communications network 190. An exemplary user interface 130 is the AURORA™ Interface and Diagnostics (AID) detachable module. Other user interfaces include smart thermostats, mobile devices including smart phones, IPAD™ IPHONE™, ITOUCH™ and GOOGLE™ devices, and computing devices. User interfaces may also be used to communicate with communications logic 128 via communications network 190. In one embodiment user interface 130 includes a graphical user interface (GUI) 132.

While the embodiments described herein are described with reference to a target space being, generally, air in a facility, the embodiments are not so limited. The embodiments described herein may find utility in any system to exchange energy. In one example, source loop 104 is coupled to a water heater. Source loop 104 is then able to inject heat to the water heater. In another example, source loop 104 is coupled with a refrigeration unit. Source loop 104 is then able to reject heat from the refrigeration unit to the environment. In a further example, source loop 104 is coupled with a combustion engine, e.g. a generator, to exchange energy with the engine. The engine may require heat before starting in winter or may require cooling to operate efficiently in summer. A heat exchanger may be provided or the apparatus may incorporate heat exchanging structure, e.g. piping and fans or pumps. A thermocouple may be affixed directly to the apparatus. Heat of extraction/rejection may be calculated based on temperature changes to the structure of the apparatus. The source loop may be coupled to heat and/or cool any other apparatus. Control module 120 may then control a target temperature of the apparatus.

Figure 2:
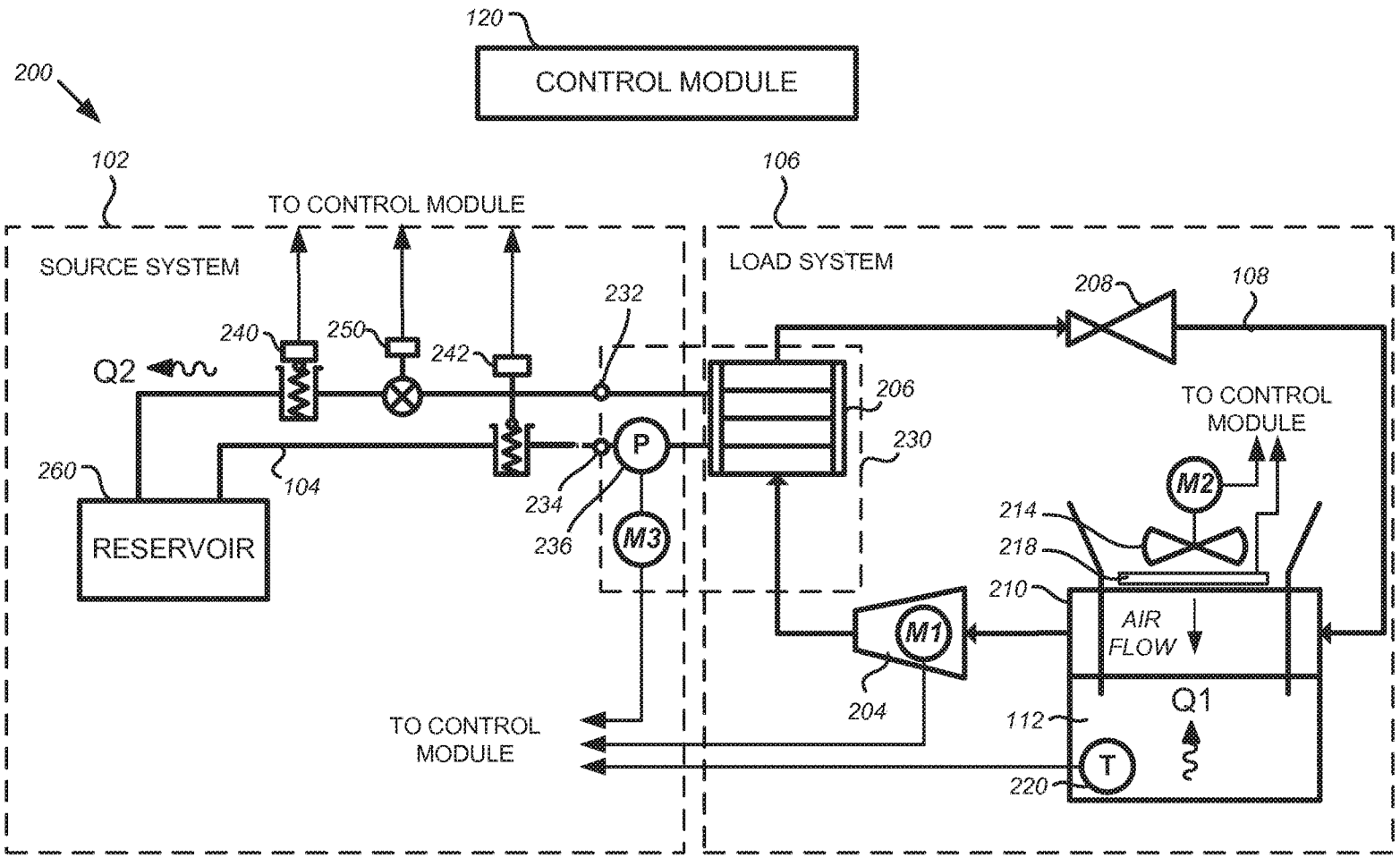
FIG. 2 is a block diagram of a space conditioning system in accordance with an embodiment set forth in the disclosure.

FIG. 2 is a block diagram of an embodiment of a liquid/liquid space conditioning system, denoted by numeral 200. In the present embodiment, load loop 108 includes a compressor unit 204 including a motor M1, a condenser unit 206, an expansion valve 208 and a coil unit 210. Adjacent coil unit 210 are a coil fan 214 driven by a motor M2, and a heater 218. An electric heater is shown. Coil fan 214 is driven by a variable speed drive (VSD 720, shown in FIG. 7) to blow air through coil unit 210 into target space 112. In winter, air is heated by heater 218, if necessary. A temperature sensor 220 provides a temperature signal indicative of the temperature in target space 112 to control module 120. Temperature sensor 220 may be comprised in a thermostat (not shown) or may be provided separately, as known in the art. A user may program the thermostat with the setpoint temperatures. The thermostat may provide on/off signals to initiate and suspend heating and cooling. Alternatively, the user may utilize a user interface or a computing device to program setpoint temperatures in control module 120, which in the present example includes temperature control logic (not shown) that determines if heating or cooling are required and takes the appropriate heating or cooling control action.

A unit 230 includes condenser 206, a pump 236, an outlet port 232 and an inlet port 234. Pump 236, powered by a motor M3, circulates liquid out of outlet port 232 and draws the liquid from reservoir 260 which flows through inlet port 234 to complete the loop. The outflow and inflow temperatures of the liquid are sensed, respectively, by temperature sensors 240 and 242. The outflow and inflow temperatures may be sensed, respectively, near outlet port 232 and an inlet port 234. A flow sensor 250 generates a flow signal configured to determine the flow rate of the fluid in source loop 104. Mass flow is determined based on flow rate. Energy exchange is based on mass flow and the temperature differential. These variables may also be determined by sensing flow and temperature on the load side of condenser 206, for example. Exemplary reservoirs include tanks, wells, lakes, loops including earth ground and water loops, and any other structure configured to contain liquids.

Mass flow may also be determined for air loops. An exemplary air source loop is described with reference to FIG. 8. Energy exchanged by the space conditioning system can similarly be determined for air based load loops by acquiring corresponding sensor data.

Figure 7:
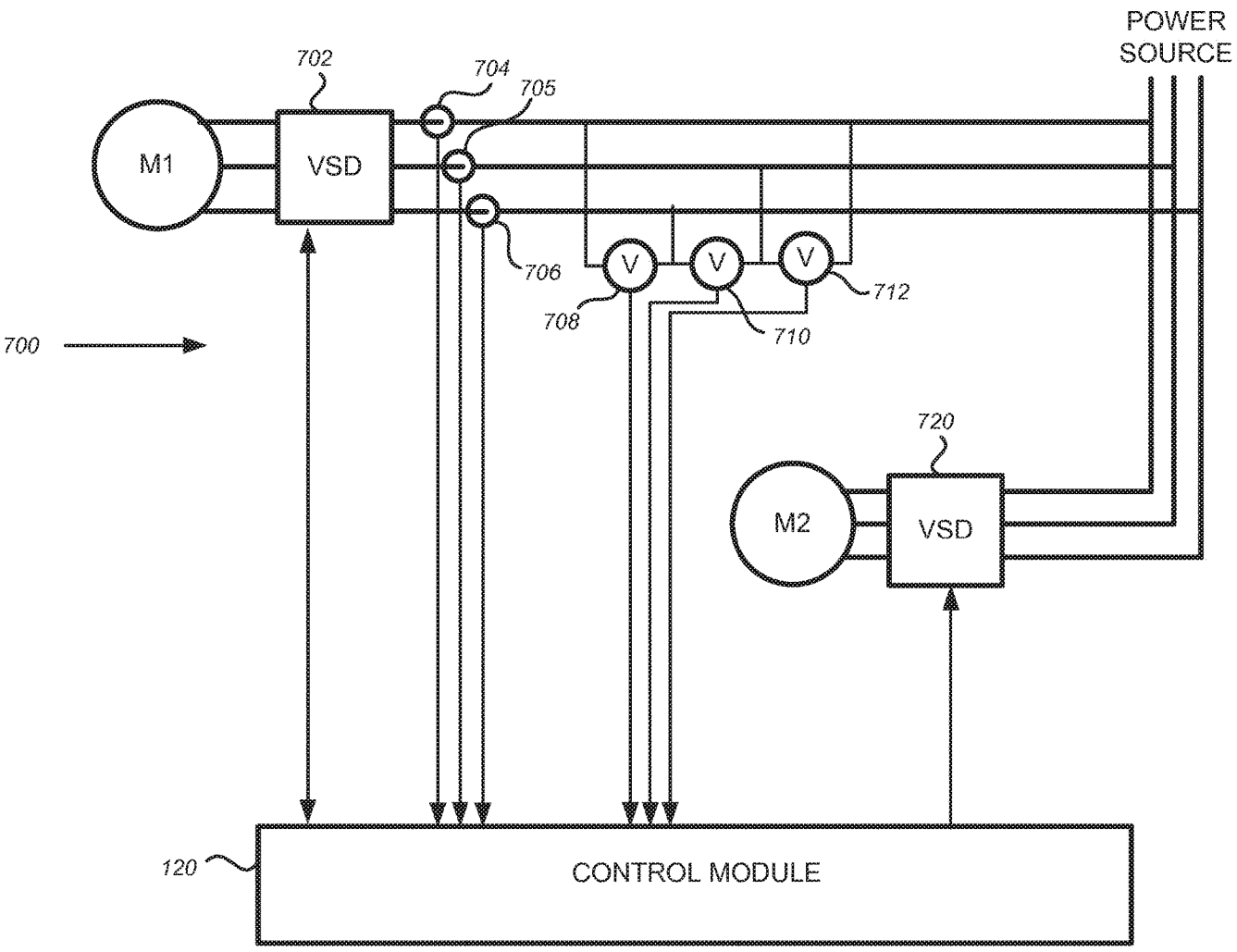
FIG. 7 is a schematic diagram of a power monitoring system in accordance with an example set forth in the disclosure.

In the present embodiment, each of the power consumers may be monitored with current sensors (not shown) such as current transformers. As shown in FIG. 7, the system voltage can be sensed, and the power consumed by each consumer can be calculated based on the voltage of the system and the current drawn by the power consumer. This arrangement minimizes the complexity of system 100 and, therefore, its cost. The current and voltage signals are provided to performance monitoring logic 124 to perform the power calculations. Additional voltage sensors may be added in the case all of the heat pump system components are not powered by the same voltage system, or to increase the measurement accuracy. Sensors are provided to measure both single and three-phase power consumption.

The term "logic" or "control logic" as used herein includes software and/or firmware executing on one or more computers, central processing units, programmable processors, application-specific integrated circuits, field-programmable gate arrays, digital signal processors, hardwired logic, or combinations thereof. Therefore, in accordance with the embodiments, various logic may be implemented in any appropriate fashion and would remain in accordance with the embodiments herein disclosed.

The terms "circuit" and "circuitry" refer generally to hardwired logic that may be implemented using various discrete components such as, but not limited to, diodes, bipolar junction transistors, field effect transistors, etc., which may be implemented on an integrated circuit using any of various technologies as appropriate, such as, but not limited to CMOS, NMOS, PMOS etc.

Several features are described below which enable construction of a low cost but accurate performance monitoring system. Embodiments of the performance monitoring system are operable with a heat pump system and with other energy consuming systems.

Figure 3:
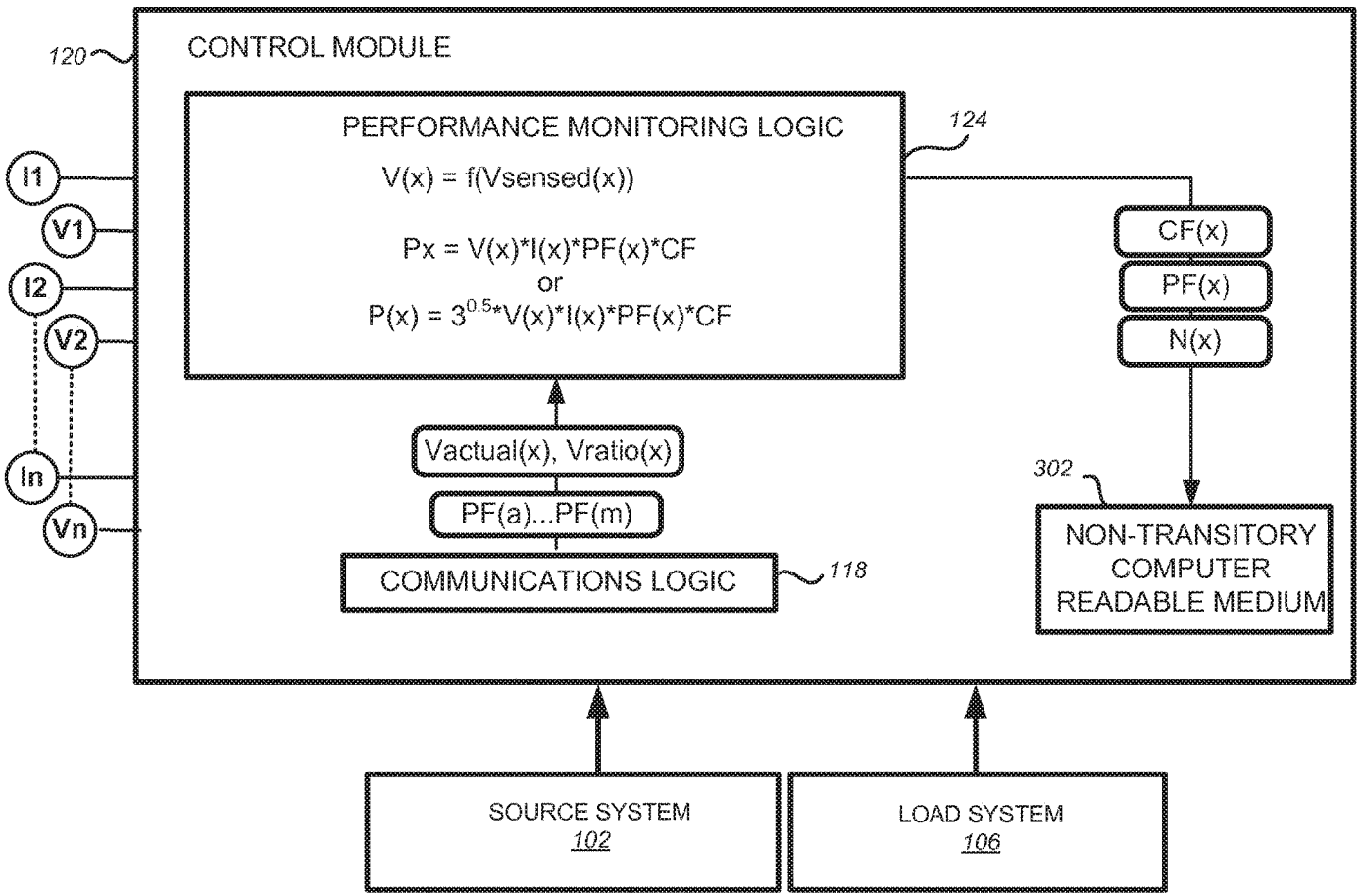
FIG. 3 is a block diagram of a control module in accordance with a further embodiment set forth in the disclosure.

Embodiments of performance monitoring logic 124 will now be described with reference to FIG. 3. FIG. 3 shows control module 120 coupled to source system 102 load system 106. A plurality of voltage and current sensors I1-In and V1-Vn are shown, which are provided to sense the voltage and current of a plurality of power consumers. Sensors I1-In and V1-Vn may be referred to as sensors I(x) and V(x), where x={1 . . . n}. Control module 120 receives a transformation data and transforms the sensed voltage, the sensed current or the calculated power based on the transformation data. The transformation data may include one or more of a hardware parameter and an actual value of the current, voltage, power factor or the power sensed with a meter from time to time. Sensors I(x) and V(x) are provided to sense single or three-phase power, based on the load type.

Figure 5:
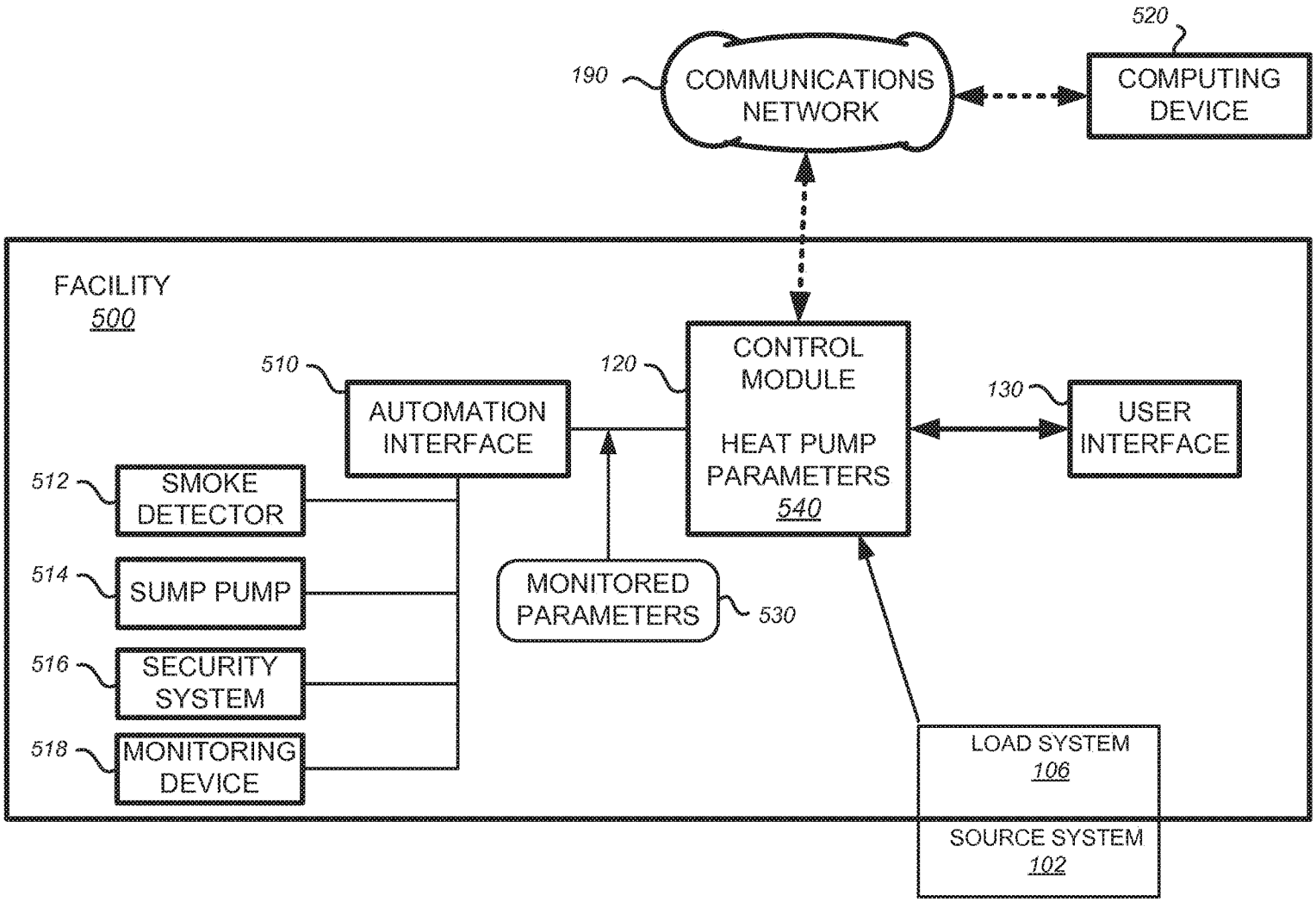
FIG. 5 is a block diagram of a facility including a heat pump system in accordance with an embodiment set forth in the disclosure.

In one embodiment, performance monitoring logic 124 is configured to determine a voltage and a current related to a power consumer to estimate power consumed by the power consumer, to determine the energy exchanged by the fluid with the environment, to calculate performance information relating to the power and the energy, and to present the power, energy and/or performance information with a user interface. Exemplary user interfaces include a smart thermostat, an integrated user input device and display device coupled with control module 120, a processing device removably coupled with control module 120, and a computing device coupled with control module 120 via a communications network, as shown in FIG. 5.

In one embodiment, a calibration factor (CF) may be introduced to economically determine power. Exemplary CF's include a transformation model, voltage calibration factor (VCF), current calibration factor (ICF) and power or power factor calibration factor (PCF). The calibration factors may be referred to, more generally, as transformation data. The sensed data and the calibration factor are applicable to single and three-phase systems. In one example of a method for determining power consumption, the transformation data, or CF or PCF, comprises a power factor value of a power consumer. A power factor value characteristic of a power consumer type and/or model may be determined experientially and provided to performance monitoring logic 124 via communications logic 128. Exemplary power factors PF(a)-PF(m) are shown to illustrate transmission of power factor values from communications logic 128 to performance monitoring logic 124. In the present example, m is less than or equal to n, to represent that some power consumers may be single phase power consumers. Performance monitoring logic 124 estimates the power consumed by the power consumer or the power branch to which the power consumer is electrically coupled, depending on the number and placement of the voltage and current sensors. Three-phase power is calculated as $p(x)=\sqrt{3}*v(x)*i(x)*PF(x)$, where x is a particular power consumer and v(x) is a voltage supplied to the power consumer. Single-phase power is calculated as $p(x)=v(x)*i(x)*PF(x)$, where x is a particular power consumer and v(x) is a voltage supplied to the power consumer. Both computations are shown in FIG. 3.

In another example of a method for determining power consumption, the transformation data comprises a VCF. In one example, VCF(x) is calculated based on the actual voltage, Vactual(x), available to a power consumer(x). The actual voltage may be measured, for example, with a voltage meter coupled to the terminals of power consumer(x). The actual voltage may be provided to performance monitoring logic 124 via communications logic 128. Based on the relationship between the actual and sensed voltages, performance monitoring logic 124 determines and stores the value of VCF(x) in a non-transitory computer readable medium 302. Performance monitoring logic 124 also stores a parameter representative of the type of relationship. Performance monitoring logic 124 subsequently calibrates the sensed voltage, Vsensed(x), with VCF(x) to determine v(x) and p(x). Exemplary relationship types include a difference, a ratio, and any other relationship. In one example, v(x) =Vsensed(x)+VCF(x). In another example, v(x)=Vsensed (x)*VCF(x). In a further example, v(x)=Vsensed(x)+f(VCF (x)). In a further example, the transformation data comprises an ICF and is calculated based on the actual current, Iactual(x), flowing through the power consumer.

In another example, the VCF is calculated based on the step-down ratio, Vratio, of a voltage sensor, e.g. a voltage transformer. The step-down ratio N(x) may be provided to performance monitoring logic 124 via communications logic 128. Performance monitoring logic 124 determines VCF(x) based on the step-down ratio N(x) and stores the value of VCF(x) in non-transitory computer readable medium 302. Performance monitoring logic 124 subsequently calibrates the sensed voltage, Vsensed(x), with VCF(x) to determine v(x) and p(x). The voltage transformer may be located remotely from control module 120 so as to maintain separation between the power and control signals.

In one variation of the present embodiment, the transformation data comprises a transformation model. In one example, performance monitoring logic 124 is operable to calculate the CF based on a current model configured to transform a non-sinusoidal current sensed by a current sensor. The current model may be stored in non-transitory computer readable medium 302. A model may be downloaded via communications logic 128 for each power consumer. An exemplary non-sinusoidal load is an electronically commutated motor (ECM). In one example, the non-sinusoidal current comprises spaced-apart half-cycles of a sinusoidal curve, and the CF for the non-sinusoidal current is a model, where:

$$v(x)=[a+b*v(y)]*v(y), \text{ for } v(y)<k; \text{ and}$$

$$v(x)=v(y), \text{ for } v(y)\geq k$$

The foregoing examples of a method for determining power consumption are operable to determine the performance of a heat pump system such as a heat pump system. Referring again to FIG. 2, in one example, the inflow temperature Tin and the outflow temperature Tout of source loop 104, and the flow rate Frate through source loop 104 are monitored. The heat of extraction/rejection, Q2, is calculated as follows:

$$Q2\ [\text{Btuh}]=\text{Frate}\ [\text{gpm}]*\text{heat transfer coefficient}*(Tin-Tout)[^\circ\ \text{Farenheit}]$$

The heat transfer coefficient is based on the type of fluid in source loop 104, and equals 500 for water and approximately 485 for typical antifreeze applications. Heat transfer coefficients may be stored in non-transitory computer readable medium 302 or may be downloaded via communications logic 128. A user may access control module 120 via communications logic 128 to select a fluid type. Control module 120 then uses the heat transfer coefficient corresponding to the selected fluid type.

A thermal performance parameter of the heat pump system may be determined to monitor the performance of the system under different circumstances and over time. A coefficient of performance (COP) of the heat pump system may be computed as the ratio of the power output to the power input. The COP may be calculated as follows:

Heating mode:

$$COP=\frac{[Q2+P]}{P},$$

where P is the power consumed by the system

Cooling mode:

$$COP=\frac{[Q2-P]}{P},$$

where P is the power consumed by the system $$P=\sum_{1}^{n}p(x),$$

where p(x) is the power consumed by power consumers of the system

Another known thermal performance parameter is the energy efficiency ratio (EER), which is determined as the ratio of output cooling (in BTU/h) to input electrical power (in watts) at a given operating point. EER is generally calculated using a 95° F. outside temperature and an inside temperature of 80° F. and 50% relative humidity. EER is like COP except that COP is dimensionless. Control module 120 may output thermal performance parameter and power. Control module 120 may also output the values for particular times of day or week, such as peak periods for weekdays and weekends.

Figure 4:
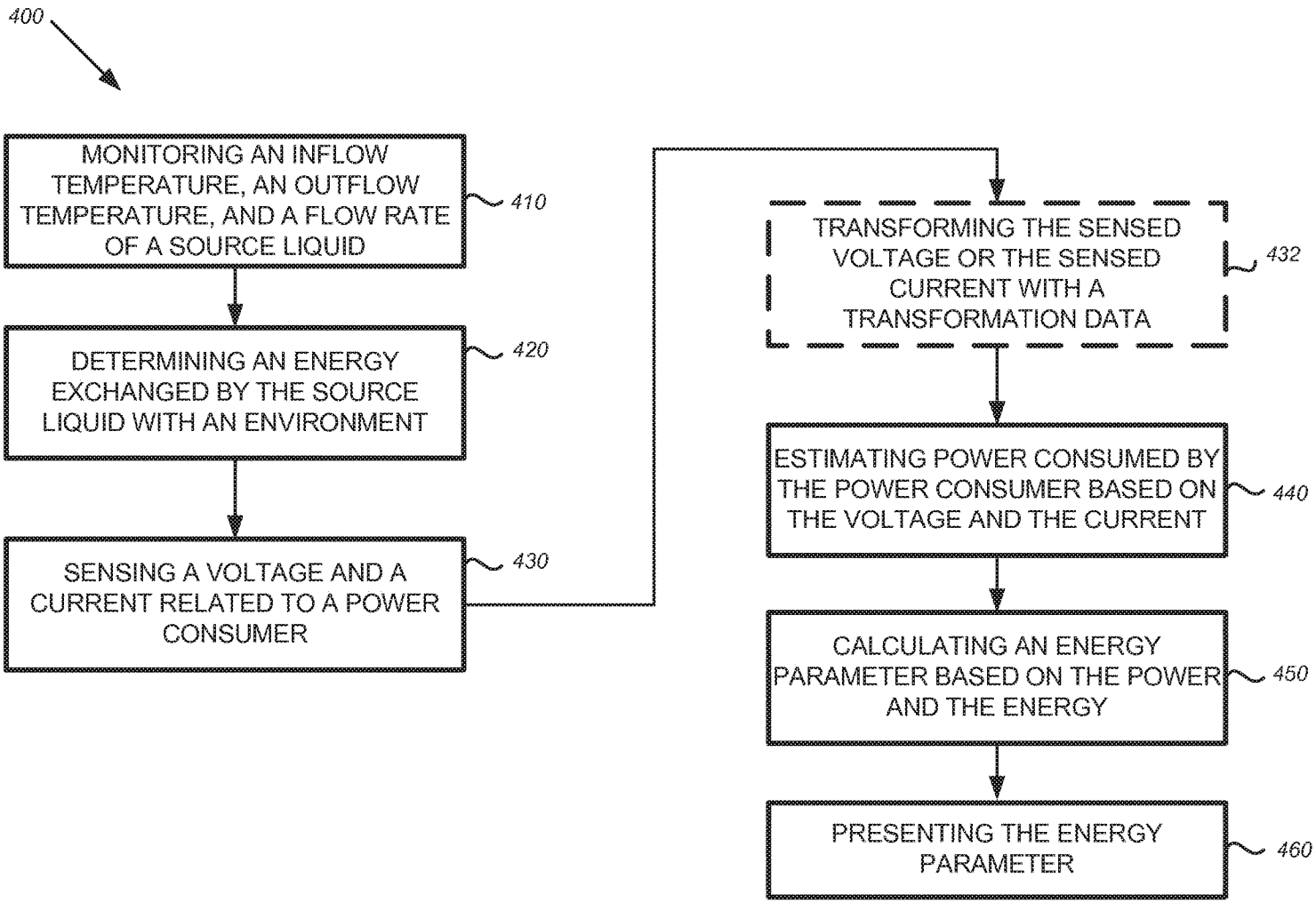
FIG. 4 is a flowchart of a monitoring method in accordance with an embodiment set forth in the disclosure.

FIG. 4 is a flowchart 400 of an embodiment of method for monitoring a heat pump system. The method may be implemented with control module 120. At 410, the method begins with monitoring an inflow temperature, an outflow temperature, and a flow rate of a source fluid. The source fluid may be air, water, brine, or any other fluid.

At 420, the method continues with determining an energy exchanged by the source fluid with an environment.

At 430, the method continues with determining a voltage and a current related to a power consumer. The voltage and the current may be determined, for example, by reading analog values of the current and the voltage with an ADC circuit, by receiving the values from current and voltage sensors in digital form or by receiving the values from other devices, such as a variable speed drive driving a motor.

Optionally, at 432, the method continues with transforming the sensed voltage or the sensed current with a transformation data. The sensed data may include actual values measured from time to time. In another example, the transformation data includes a transformation model or a power parameter measured with a power meter from time to time.

At 440, the method continues with estimating power consumed by the power consumer based on the voltage and the current. The estimation may also be based on the transformation data.

At 450, the method continues with calculating an energy parameter based on the power and the energy. The energy parameter may be a ratio of the power and energy, for example. The energy parameter may be the COP of the system.

At 460, the method continues with presenting the power, heat of extraction/rejection, and/or energy parameter with a user interface.

Having determined an economical system for measuring electrical power and performance parameters, such as heat of extraction/rejection and COP, a user may monitor the parameters and program desired temperatures to optimize energy consumption. The user may also display the performance parameters in real time on a user interface such as the AURORA™ AID detachable module.

In another embodiment, the efficiency of a heat pump system may be improved during demand limited periods by taking into account the recovery time of the heat pump. In one example, a home is outfitted with smart utility meter 180, and the utility company commands smart utility meter 180 to cause control module 120 to reduce electrical consumption. Smart utility meter 180 may communicate wirelessly (denoted by dashed lines) with control module 120. Demand limiting logic 126 is configured to modify the operation of the heat pump system so as to reduce electrical energy consumption when smart utility meter 180 provides an on-peak signal. In another example, the utility company communicates thorough the internet with control module 120, and smart utility meter 180 is not required. Demand limiting logic 126 is configured to modify the operation of the heat pump system so as to reduce electrical energy consumption when the utility company provides an on-peak signal. In a further example, the user may schedule a forecasted on-peak time to modify the operation of the heat pump system so as to reduce electrical energy consumption based on the prediction. The prediction may be based on publicly available data.

In one example, the demand limiting logic shuts down at least the heat pump compressor for a predetermined time. In another example, the demand limiting logic limits current draw to a predetermined level by limiting the speed of a motor, such as motor M1. The compressor unit may have a variable speed motor or multi-step capacity, in which case a lower speed or step may be set, or a dual-speed motor, in which case the lower speed may be set, to save energy. Additionally, in another embodiment, power consumption may be optimized by limiting fluid flows in both heat exchangers if the temperature differential across a loop is small. For example, the pump in the source loop may be slowed down if the temperature differential between the inflow and outflow temperatures is small. In yet another embodiment, an variable expansion valve may be provided and set by the control module to maintain an optimal superheat setting for maximum efficiency.

In a further example, the demand limiting logic is programmable, and a user may program the demand limiting logic to select a demand limiting mode in response to the on-peak signal. In one example, the demand limiting logic may implement one or more of the following control strategies:

(a) take no action;
(b) disable operation of the heat pump during the on-peak period;
(c) disable operation of the heat pump during a predetermined time;
(d) limit the capacity of the heat pump to a predetermined portion of the heat capacity; or
(d) switch the programmed thermostat setting to an on-peak thermostat setting which reduces power consumption relative to an off-peak setting.

Additional control strategies may also be implemented by the demand limiting logic. Further, the demand limiting logic may be implemented without programmability, by predefining a control strategy.

In one embodiment, the communications logic is capable of communicating monitored heat pump parameters with a computing device via the internet using a website or a mobile device application. The communications logic may, for example, wirelessly access a router in the facility, and through the router access the internet. The user can therefore access the heat pump system and view the monitored parameters by accessing a corresponding website or, with a mobile device application, accessing the communications logic. In one example, the user can also modify control parameters of the heat pump system, such as for example to activate or deactivate the demand limiting logic or to select a demand limiting mode.

In another embodiment, an automation interface is configured to receive monitored parameters from peripheral devices, including monitoring devices. FIG. 5 is a block diagram of a heat pump system operating in a facility 500. Exemplary facilities include homes, commercial buildings, factories, administrative building, and any other enclosed spaces capable of utilizing at least one heat pump system to control the enclosed space. The heat pump system, which may be any one of the heat pump system described herein, including systems 200 and 800 (shown in FIG. 8), includes control module 120 and an automation interface 510. Communicatively coupled with automation interface 510 are monitoring devices. Exemplary monitored devices are shown, including a smoke detector 512, a sump pump 514, a security system 516 and a generic monitoring device 528 representing any other automation system or device to be monitored. The parameters from the peripheral devices are communicated by automation interface 510 to control module 120 and communicated further by control module 120 to a computing device 520, in the manner described above. Exemplary peripheral parameters may include parameters from sump pumps, smoke detectors, carbon monoxide and dioxide detectors, dirty filter alarms, security system parameters, and any other parameter that can be communicated to or sensed by the automation interface. Exemplary monitored parameters 530 types include variables, alarms, images, sound and video. Automation interface 510 and control module 120 communicate the monitored parameters in the same manner as the heat pump parameters are communicated. In one example, selected parameters are also communicated to corresponding responders. For example, a heat pump alarm, fire alarm and security alarm may be communicated, respectively, to a service company responsible for repairing the heat pump, the fire department, and a security company or police station.

As used herein, a processing or computing system or device may be a specifically constructed apparatus or may comprise general purpose computers selectively activated or reconfigured by software programs stored therein. The computing device, whether specifically constructed or general purpose, has at least one processing device, or processor, for executing processing instructions and computer readable storage media, or memory, for storing instructions and other information. Many combinations of processing circuitry and information storing equipment are known by those of ordinary skill in these arts. A processor may be a microprocessor, a digital signal processor (DSP), a central processing unit (CPU), or other circuit or equivalent capable of interpreting instructions or performing logical actions on information. A processor encompasses multiple processors integrated in a motherboard and may also include one or more graphics processors and embedded memory. Exemplary processing systems include workstations, personal computers, portable computers, portable wireless devices, mobile devices, and any device including a processor, memory and software. Processing systems also encompass one or more computing devices and include computer networks and distributed computing devices.

As used herein, a communications network is a system of computing systems or computing devices interconnected in such a manner that messages may be transmitted between them. Typically one or more computers operate as a "server", a computer with access to large storage devices such as hard disk drives and communication hardware to operate peripheral devices such as printers, routers, or modems. Other computers, termed "clients", provide a user interface so that users of computer networks can access the network resources, such as shared data files, common peripheral devices, and inter workstation communication. User interfaces may comprise software working together with user input devices to communicate user commands to the processing system. Exemplary user input devices include touch-screens, keypads, mice, voice-recognition logic, imaging systems configured to recognize gestures, and any known or future developed hardware suitable to receive user commands.

As used herein, a non-transitory computer readable storage medium comprises any medium configured to store data, such as volatile and non-volatile memory, temporary and cache memory and optical or magnetic disk storage. Exemplary storage media include electronic, magnetic, optical, printed, or media, in any format, used to store information. Computer readable storage medium also comprises a plurality thereof.

The space conditioning system may comprise additional monitoring logic to monitor coil and condenser pressures and temperatures, motor currents, and timing between commands and changes in the temperatures, pressures and currents. Based on these parameters, the monitoring logic may determine faults and initiate alarms. The parameters, fault signals, and alarm signals may also be communicated via communications logic 128 to a local or remote computing system to notify the user or a service provider concerning the operation of the heat pump system.

Figure 6:
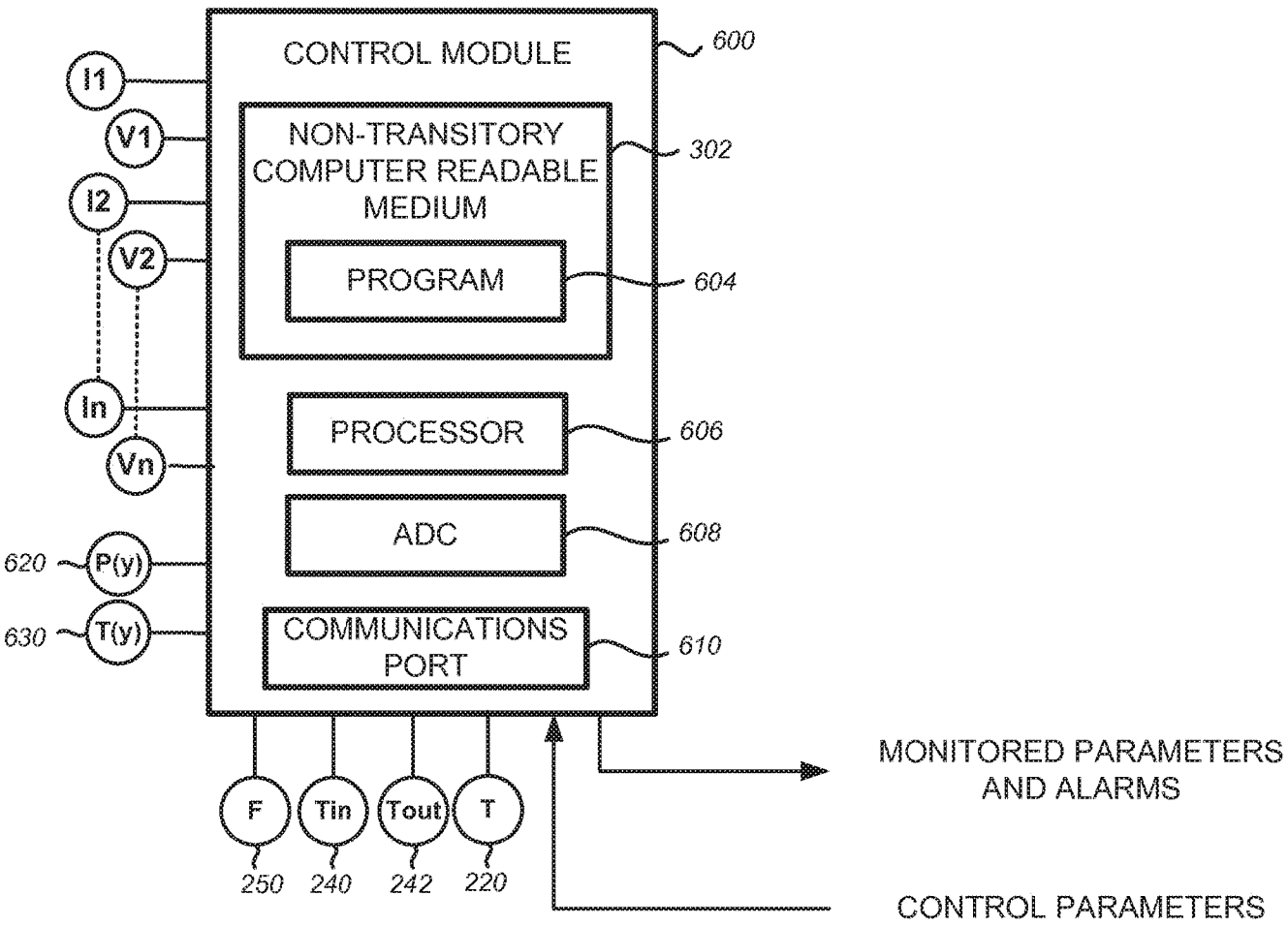
FIG. 6 is a block diagram of another control module in accordance with a further embodiment set forth in the disclosure.

FIG. 6 is a block diagram of an embodiment of a control module 600. Control module 600 includes non-transitory computer readable medium 302 having stored therein a program 604 configured to cause a processor 606 to execute program instructions configured to perform the functions described previously with reference to control module 120. Control module 600 further includes a communications port 610, as known in the art, operable to transmit monitored parameters and alarms and to receive control parameters as described above with reference to FIGS. 1-3 and 5. Communications logic 128 may comprise communications port 610.

Control module 600 further includes an analog to digital converter (ADC) circuit 608 configured to read analog signals. Analog signals may be provided by voltage and current sensors I(x) and V(x), a plurality of pressure and temperature sensors P(y) 620 and T(y) 630, respectively, operable to read coil and condenser pressures and temperatures, and other pressures and temperatures, temperature sensors 240 and 242, and flow sensor 250. Sensors I(x) and V(x) are provided to sense single or three-phase power, based on the load type. Additional circuits may be provided to convert temperature signals to voltages or currents in the event the temperature sensors do not perform such conversion. Any of the sensors described herein may include an ADC circuit to convert the corresponding sensed values to digital values and a communication port, e.g. a serial communication port, to communicate the digital value to control module 600, as known in the art. Control module 600 may also include multiplexing logic for multiplexing the analog signals, as known in the art.

Automation interface 510 may be configured in a similar manner to receive information from peripheral devices. In one example, automation interface 510 includes a processor and a non-transitory computer readable medium having embedded therein a monitoring program operable, when executed by the processor, to read signals from peripheral devices and to communicate such signals to control modules 120 or 600. Automation interface 510 may also include an ADC circuit and a communications port.

FIG. 7 is a block diagram of an exemplary power monitoring arrangement 700 including control module 120. Motors M1 and M2 are shown, powered by variable speed drives (VSD) 702 and 720, respectively, which receive three-phase power from the same power source. Voltage meters 708, 710 and 712 sense the phase-to-phase voltages of the power source and provide corresponding voltage signals to control module 120. As stated above, a user may provide a calibration factor, such as a power factor, to control module 120 to calibrate the monitored parameter. In the present embodiment, current transformers 704, 705 and 706 provide current signals corresponding to the current drawn on three phases of the power source by VSD 702. VSD 720 has the capability to determine the current drawn by motor M2 and to communicate the sensed current signal to control module 120. In one example, VSD 720 may communicate the power consumed by motor M2. Control module 120 then calculates power consumed by motors M1 and M2. The same topology is used to sense power consumed by motors M3 and M4, the electric heater, and any other fans and pumps of the heat pump system. Control module 120 may also receive voltage and current signals from additional voltage and current sensors configured to sense phase voltages and additional line currents of single or three-phase power consumers. Different voltage and current sensor arrangements may be configured to provide a meaningful power computation while managing installation and equipment costs to suit each facility.

Figure 8:
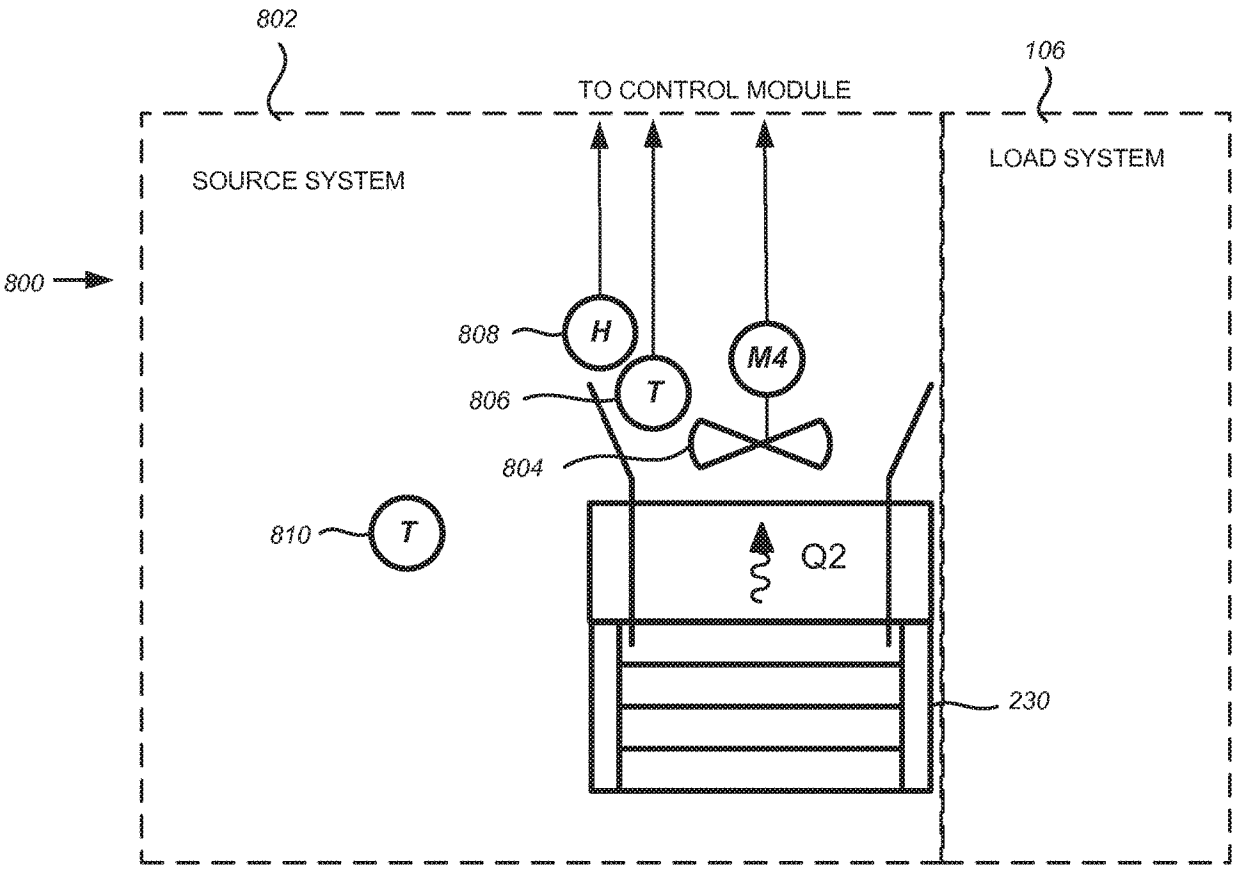
FIG. 8 is a schematic diagram of a heat pump system with an air source system in accordance with another example set forth in the disclosure.

The preceding embodiments illustrated space conditioning systems with liquid source loops. FIG. 8 is a block diagram of an embodiment of a heat pump system, denoted by numeral 800, with an air source loop. System 800 includes a load system 106. An exemplary load system 106 was previously described with reference to FIG. 2. System 800 also includes a source system 802 including a fan 804 ventilating condenser 230. Fan 804 is driven by motor M4. The temperature and humidity of the ventilated air is sensed by temperature sensor 806 and humidity sensor 808. The ambient temperature is sensed by temperature sensor 810. The ventilated air flow may be determined based on the speed and surface area of fan 804. The temperature differential between the ventilated air and the ambient air, together with the ventilated air humidity, may be used to calculate the heat of extraction/rejection of the system and the COP. In another embodiment, a space conditioning system comprises an air load loop. In one example, the air load loop is thermally coupled to an air source loop. In a further example, the air load loop is thermally coupled to a liquid source loop, e.g. a water loop.

The above detailed description of the invention and the examples described therein have been presented only for the purposes of illustration and description. It is therefore contemplated that the present invention cover any and all modifications, variations or equivalents that fall within the spirit and scope of the basic underlying principles disclosed above and claimed herein.

What is claimed is:

1. A heat pump system configured for control of efficiently conditioning of air in a space, the heat pump system comprising:

a source heat exchanger positioned along a source loop;

a load heat exchanger positioned along a load loop;

a pump driven by a first motor operable to circulate a source liquid through the source loop;

a first voltage sensor configured to detect a first uncalibrated electrical voltage provided to the first motor;

a first current sensor configured to detect a first uncalibrated electrical current drawn by the first motor;

a compressor driven by a second motor operable to circulate a refrigerant through the load loop;

a second voltage sensor configured to detect a second uncalibrated electrical voltage provided to the second motor;

a second current sensor configured to detect a second uncalibrated electrical current drawn by the second motor;

a first temperature sensor disposed on the source loop upstream of the source heat exchanger to measure an inflow temperature of the source liquid;

a second temperature sensor disposed on the source loop downstream of the source heat exchanger to measure an outflow temperature of the source liquid;

a flow sensor disposed on the source loop to measure an actual flow rate of the source liquid; and a control module in communication with the first and second voltage sensors, the first and second current sensors, the first and second temperature sensors, and the flow sensor, the control module including a processor, memory, and a user interface, the control module being configured to wirelessly display in real time via the user interface a duration of a recovery period for the air in the space to reach a selected setpoint temperature from a selected setback temperature, and, to increase an efficiency of the conditioning of the air based on the recovery period, the control module being configured to determine a thermal energy exchange rate of the source heat exchanger with the source liquid, determine a first electrical energy consumption rate of the first motor, determine a second electrical energy consumption rate of the second motor, determine a total electrical energy consumption rate based on the first and second electrical energy consumption rates, and in response to wirelessly receiving an on-peak signal from a smart meter, adjust a start time of the recovery period based on (i) the duration of the recovery period, (ii) the thermal energy exchange rate, and (iii) the total electrical energy consumption rate to limit power consumption of at least one of the compressor, the first motor, and the second motor during an on-peak time.

2. The system as in claim 1, wherein the control module is configured to determine the thermal energy exchange rate of the source heat exchanger with the source liquid based on the inflow and outflow temperatures, the actual flow rate, and a heat transfer constant related to the source liquid stored in the memory, determine a first calibrated supply voltage based on the first uncalibrated electrical voltage and a first voltage calibration factor related to the first motor stored in the memory, determine the first electrical energy consumption rate of the first motor based on the first calibrated supply voltage, the first uncalibrated electrical current, and a first electrical power factor related to the first motor stored in the memory, determine a second calibrated supply voltage based on the second uncalibrated electrical voltage and a second voltage calibration factor related to the second motor stored in the memory, and determine the second electrical energy consumption rate of the second motor based on the second calibrated supply voltage, the second uncalibrated electrical current, and a second electrical power factor related to the second motor stored in the memory.

3. The system as in claim 2, including a fan driven by a third motor operable to circulate the air over the load heat exchanger, the third motor being in communication with the control module;

a third voltage sensor configured to detect a third uncalibrated electrical voltage provided to the third motor; and a third current sensor configured to detect a third uncalibrated electrical current drawn by the third motor.

4. The system as in claim 3, wherein the control module is configured to determine a third calibrated supply voltage based on the third uncalibrated electrical voltage and a third voltage calibration factor related to the third motor stored in the memory, determine a third electrical energy consumption rate of the third motor based on the third calibrated supply voltage, the third uncalibrated electrical current, and a third electrical power factor related to the third motor stored in the memory, and determine the total electrical energy consumption rate based on the third electrical energy consumption rate.

5. The system as in claim 1, including an automation interface adapted to electronically couple with peripheral devices and to communicate monitored parameters of the peripheral devices to the control module, wherein the control module is configured to communicate the monitored parameters of the peripheral devices for presentation via the user interface.

6. The system as in claim 1, wherein the control module is configured to determine the first and the second voltage calibration factors based on a first and a second step-down ratio of the first and the second voltage sensors, respectively.

7. The system as in claim 1, wherein the first and second motors are three-phase motors electrically powered by a three-phase power source.

8. The system as in claim 1, wherein to limit the power consumption during the on-peak time, the control module is configured to limit a current draw of at least one of the first motor, the second motor, and the compressor.

9. The system as in claim 1, wherein the control module comprises a communication interface that is configured to receive the on-peak signal from the smart meter via wireless communication.

10. The system as in claim 1, wherein to limit the power consumption in response to receiving the on-peak signal from the smart meter, the control module is configured to limit a fluid flow.

11. The system of claim 1, wherein the control module is configured to wirelessly display, via the user interface, heat exchange efficiency data for the source and the load heat exchangers and electrical consumption efficiency data for electrical consumption of the compressor and the first and second motors.

12. The system of claim 1, wherein the control module is configured to predict the on-peak time based on publicly available data.

13. The system of claim 1, wherein the control module is configured to receive the selected setpoint temperature and the selected setback temperature from a user via the user interface.

14. The system of claim 1, wherein, to limit the power consumption, the control module is configured to limit a rotational speed of at least one of the first motor and the second motor.

15. A heat pump for control of efficiently conditioning of air in a space, the heat pump comprising:

a refrigerant-to-liquid source heat exchanger;

a source loop coupled to the refrigerant-to-liquid source heat exchanger and configured to convey a source liquid, the source loop comprising a pump driven by a first motor to circulate the source liquid, the first motor being in communication with a first voltage sensor and a first current sensor, a first temperature sensor disposed upstream of the refrigerant-to-liquid source heat exchanger to measure an inflow temperature of the source liquid, a second temperature sensor disposed downstream of the refrigerant-to-liquid source heat exchanger to measure an outflow temperature of the source liquid, and a flow meter to measure a flow rate of the source liquid in the source loop;

a load loop to convey a refrigerant and coupled to a refrigerant-to-air load heat exchanger, the load loop comprising a compressor driven by a second motor to circulate the refrigerant, the second motor being in communication with a second voltage sensor and a second current sensor; and a control module in communication with the first and second voltage sensors, with the first and second current sensors, with the first and second temperature sensors, and with a flow sensor, the control module including a processor and memory, the control module being configured to wirelessly present in real time, via a user interface, a duration of a recovery period for the air in the space to reach a selected setpoint temperature from a selected setback temperature, and, to increase an efficiency of the conditioning of the air based on the recovery period, the control module being configured to determine a thermal energy exchange rate of the refrigerant-to-liquid source heat exchanger with the source liquid, determine a first electrical energy consumption rate of the first motor, determine a second electrical energy consumption rate of the second motor, determine a total electrical energy consumption rate based on the first and second electrical energy consumption rates, and in response to receiving an on-peak signal from a smart meter, adjust a start time of the recovery period based on (i) the duration of the recovery period, (ii) the thermal energy exchange rate, and (iii) the total electrical energy consumption rate to limit power consumption of at least one of the compressor, the first motor, and the second motor during an on-peak time.

16. The heat pump of claim 15, wherein the control module is configured to determine the thermal energy exchange rate of the refrigerant-to-liquid source heat exchanger with the source liquid based on the inflow and outflow temperatures, the flow rate, and a heat transfer constant related to the source liquid stored in the memory, determine a first calibrated supply voltage provided to the first motor based on a first uncalibrated sensed voltage measurement from the first voltage sensor and a first voltage calibration factor stored in the memory, determine the first electrical energy consumption rate of the first motor based on the first calibrated supply voltage, a first sensed current measurement from the first current sensor, and a first electrical power factor stored in the memory, determine a second calibrated supply voltage provided to the second motor based on a second uncalibrated sensed voltage measurement from the second voltage sensor and a second voltage calibration factor stored in the memory, and determine the second electrical energy consumption rate of the second motor based on the second calibrated supply voltage, a second sensed current measurement from the second current sensor, and a second electrical power factor stored in the memory.

17. The heat pump of claim 15, wherein the load loop comprises a fan driven by a third motor, the third motor being in communication with a third voltage sensor and a third current sensor.

18. The heat pump of claim 15, wherein the first current sensor measures a first current drawn by the first motor, and the second current sensor measures a second current drawn by the second motor.

19. The heat pump of claim 15, wherein to limit the power consumption in response to receiving the on-peak signal from the smart meter, the control module is configured to limit a fluid flow.

20. The heat pump of claim 15, wherein the control module includes a communication interface that is configured to receive the on-peak signal from the smart meter via wireless communication.

21. A method for monitoring and controlling a heat pump system to efficiently condition air in a space, the heat pump system comprising a refrigerant-to-liquid source heat exchanger coupled to a source loop through which a source liquid is conveyed, and a load loop through which a refrigerant is conveyed, the method comprising:

determining a duration of a recovery period for the air in the space to reach a selected setpoint temperature from a selected setback temperature;

determining a thermal energy exchange rate of the source loop;

determining a first electrical energy consumption rate of a first motor driving a pump operable to circulate the source liquid in the source loop;

determining a second electrical energy consumption rate of a second motor driving a compressor operable to circulate the refrigerant in the load loop;

determining a total electrical energy consumption rate based on the first and second electrical energy consumption rates;

receiving an on-peak signal from a smart meter via a communication interface; and in response to receiving the on-peak signal, adjusting a start time of the recovery period based on (i) the duration of the recovery period, (ii) the thermal energy exchange rate, and (iii) the total electrical energy consumption rate to limit power consumption of at least one of the compressor, the first motor, and the second motor during an on-peak time.

22. The method of claim 21, comprising measuring an inflow temperature of the source liquid in the source loop via a first temperature sensor disposed on the source loop upstream of the refrigerant-to-liquid source heat exchanger;

measuring an outflow temperature of the source liquid via a second temperature sensor disposed on the source loop downstream of the refrigerant-to-liquid source heat exchanger; and measuring a flow rate of the source liquid via a flow meter disposed on the source loop, wherein determining the thermal energy exchange rate of the source loop is based on the inflow temperature, the outflow temperature, the flow rate, and a heat transfer constant of the source liquid stored in a memory.

23. The method of claim 21, comprising detecting a first sensed voltage provided to the first motor via a first voltage sensor;

detecting a first electrical current drawn by the first motor via a first current sensor;

determining a first calibrated supply voltage based on the first sensed voltage and a first voltage calibration factor related to the first motor stored in a memory;

wherein determining the first electrical energy consumption rate of the first motor is based on the first calibrated supply voltage, the first electrical current, and a first electrical power factor related to the first motor stored in the memory.

24. The method of claim 23, comprising:

detecting a second sensed voltage provided to the second motor via a second voltage sensor;

detecting a second electrical current drawn by the second motor via a second current sensor;

determining a second calibrated supply voltage based on the second sensed voltage and a second voltage calibration factor related to the second motor stored in the memory;

determining the second electrical energy consumption rate of the second motor is based on the second calibrated supply voltage, the second electrical current, and a second electrical power factor related to the second motor stored in the memory.

25. The method of claim 24, comprising:

detecting a third sensed voltage provided to a third motor driving a fan operable to circulate the air across a refrigerant-to-air load heat exchanger disposed on the load loop via a third voltage sensor;

detecting a third electrical current drawn by the third motor via a third current sensor;

determining a third calibrated supply voltage based on the third sensed voltage and a third voltage calibration factor related to the third motor stored in the memory;

determining a third electrical energy consumption rate of the third motor based on the third calibrated supply voltage, the third electrical current, and a third electrical power factor related to the third motor stored in the memory;

wherein determining the total electrical energy consumption rate is based on the third electrical energy consumption rate.

26. The method of claim 21, wherein limiting the power consumption comprises limiting respective rotational speeds of at least one of the first motor and the second motor.

27. The method of claim 21, wherein limiting the power consumption comprises limiting at least one of a first electrical current of the first motor and a second electrical current of the second motor.

28. The method of claim 21, including wirelessly presenting, via a user interface, (i) the duration of the recovery period for the air in the space to reach the selected setpoint temperature from the selected setback temperature, (ii) heat exchange efficiency data for the refrigerant-to-liquid source exchanger and (iii) electrical consumption efficiency data for electrical consumption of the compressor and the first and second motors.

29. The method of claim 28, including receiving the selected setpoint temperature and the selected setback temperature from a user via the user interface.

30. The method of claim 21, including predicting the on-peak time based on publicly available data.

31. The method of claim 21, wherein limiting the power consumption comprises limiting a fluid flow.

* * * * *